United States Patent [19]

Talafuse

[11] 4,299,261

[45] Nov. 10, 1981

[54] OFFSHORE LOADING SYSTEM

[75] Inventor: Larry J. Talafuse, Spring, Tex.

[73] Assignee: FMC Corporation, San Jose, Calif.

[21] Appl. No.: 85,669

[22] Filed: Oct. 17, 1979

[30] Foreign Application Priority Data

Dec. 11, 1978 [GB] United Kingdom ..... 47994/78

[51] Int. Cl.[3] ..... B67D 5/70; B65B 3/04

[52] U.S. Cl. ..... 141/387; 137/615; 285/282

[58] Field of Search ..... 141/279, 284, 387, 388; 137/615; 285/282

[56] References Cited

U.S. PATENT DOCUMENTS

| | | | |
|---|---|---|---|
| 2,509,120 | 5/1950 | Warren | 137/21 |
| 3,805,834 | 4/1974 | Bily | 137/615 |
| 4,220,177 | 9/1980 | Gill | 141/387 |

FOREIGN PATENT DOCUMENTS

| | | | |
|---|---|---|---|
| 965648 | 4/1975 | Canada | 114/67 |
| 1050389 | 3/1979 | Canada | 137/71 |
| 2330585 | 6/1977 | France . | |
| 7019030 | 7/1972 | Netherlands . | |
| 1511313 | 5/1978 | United Kingdom . | |
| 2024151 | 1/1980 | United Kingdom . | |

*Primary Examiner*—Houston S. Bell, Jr.

*Attorney, Agent, or Firm*—W. W. Ritt, Jr.; L. B. Guernsey

[57] ABSTRACT

A lightweight articulated loading arm for transferring fluid from an offshore articulated loading column to a marine tanker, and for monitoring the position of the loading arm relative to a safe operating envelope. The arm includes an inboard conduit member mounted on the loading column for pivotal movement about a first horizontal axis, and an outboard conduit member connected to the inboard member for pivotal movement about second and third horizontal axes. A tensioner, mounted on the loading column, provides power to rotate the loading arm about the first horizontal axis and to bias the loading arm toward a stowed position. Power to operate and control the loading arm is provided by sources located on the marine tanker and coupled to the loading arm by hydraulic and/or electrical lines which are mounted on the loading column and on the loading arm. The loading arm includes a joint support so that joints on the loading arm can be serviced and maintained without disconnecting the loading arm from the loading column.

14 Claims, 8 Drawing Figures

3
4
A
B
C
D
S
M
T
36
40
40a
41
41a
41b
42
46
47
48a
48b
49
52
53a
54
58
59a
59b
60a
64a
64b
70a
72a
72b
94
95
96
108
112
113
119
124
125
126
17a
28
29
30

FIG_4
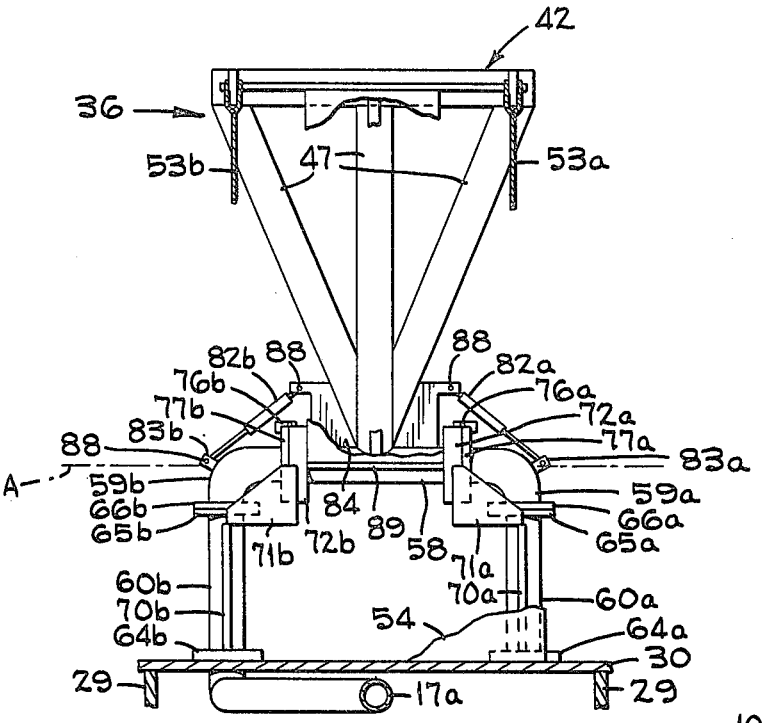
FIG_5
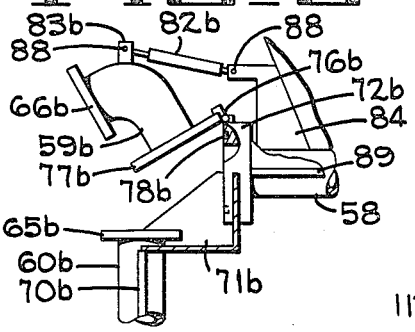
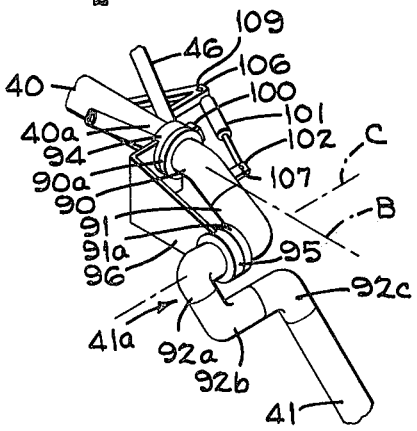
FIG_6
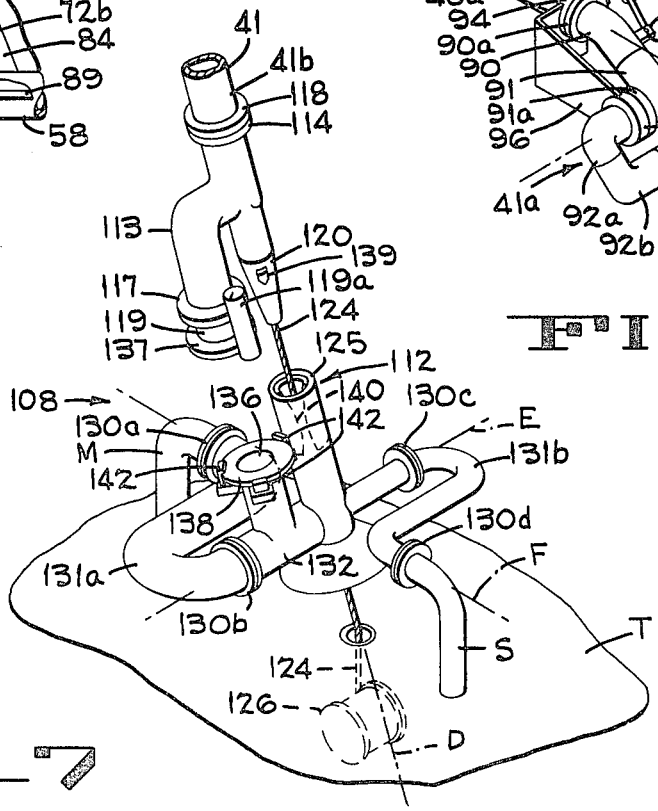
FIG_7

OFFSHORE LOADING SYSTEM

BACKGROUND OF THE INVENTION

1. Field of the Invention

This invention relates to articulated fluid transferring apparatus, and more particularly, to an improved offshore loading system having an improved articulated loading arm.

2. Description of the Prior Art

The production of oil and gas from offshore wells has developed into a major endeavor of the petroleum industry, and this growth has led to the development of means for transporting petroleum products from offshore wells to shore-based refineries or storage facilities. Many of the wells are being drilled and completed in deep-water locations where the use of marine tankers of very large capacity constitutes the most practical and efficient method of transporting the petroleum products.

Some of the prior art loading facilities include a fluid handling means such as a fixed mooring buoy or an articulated loading column to which a tanker may be moored while loading. The tanker and the loading column move relative to each other during the loading operation due to winds, tides and the amount of fluid which is loaded into the tanker. The height of the tanker above the waterline changes as the tanker is loaded or unloaded, thus requiring that a flexible or articulated hose be connected between the tanker and the loading columm. When flexible hoses are used a tender is normally required to assist the tanker in picking up the flexible hoses for connection to the tanker's manifold. Such an arrangement not only requires the use of a tender, but movement of the tanker may cause the flexible hoses to be broken. The hoses are bulky, heavy, hard to handle and require a relatively large crew of workers to connect the hoses to the tanker. The hoses are also subject to wear and deterioration, can cause pollution due to rupture caused by sudden changes in fluid pressure and must be replaced frequently. Sudden changes in pressure can rupture or otherwise damage flexible hoses, thus requiring a relatively long sequence for connecting or disconnecting a hose to a tanker and for changing the rate of moving liquid through the hose between "full flow" rate and a "no fluid" rate. This may cause damage to the hose when a sudden disconnect of the hose is required due to an unexpected storm or to other emergency factors.

Some of the other prior art loading facilities include a marine loading arm having complex articulated arms that are heavy, bulky, and relatively expensive, and that require complex balancing systems, as balance of these arms change as the fluid content of the arm changes. When these arms are mounted on the loading column, power to operate the loading arm is provided on the loading column. The installation of the power system on these loading columns is expensive and maintenance is inconvenient and expensive. What is needed is a lightweight, simple, passive loading system which can be connected to a source of power on a marine tanker being loaded from the loading tower.

SUMMARY OF THE INVENTION

The present invention comprises an offshore loading system for transferring fluid from an articulated column to a manifold or a marine tanker, and for providing relative movement between the tanker and the articulated column. This invention overcomes some of the disadvantages of the prior art by providing a loading arm having an inboard conduit member pivotally connected to the articulated column, with the inboard end of the inboard conduit member connected for pivotal movement about a first horizontal axis. A support structure connected along the inboard conduit member provides support for the inboard conduit member and includes a walkway and accompanying guard rail to accommodate personnel making repairs to the loading arm. An outboard conduit member is pivotally connected to the outboard end of the inboard conduit member for pivotal movement about a second and a third horizontal axis. A universe joint means is connected between an outboard end of the outboard conduit member and a tanker manifold to compensate for movement of the tanker relative to the articulated column. A tensioner mounted on the articulated column provides lightweight means for raising and balancing the loading arm. The use of the articulated loading arm mounted on the articulated column and the universal joint means between the outboard end of the arm and the tanker manifold compensates for both vertical and horizontal movement between the tanker and the articulated column. The use of a tensioner rather than counterweights reduces the weight of the offshore loading system.

BRIEF DESCRIPTION OF THE DRAWINGS

FIG. 4 is an enlarged end elevation of a portion of the offshore loading system taken in the direction of the arrows 4—4 of FIG. 2.

FIG. 5 is an enlarged end elevation of a portion of the offshore loading system shown in FIG. 4.

FIG. 6 is a perspective view of a portion of the offshore loading system of FIG. 2 showing details of the connection between the inboard and outboard conduit members.

FIG. 7 is a perspective of a portion of the offshore loadng system of FIG. 2 showing details of the connection between the outboard end of the outboard conduit member and a marine tanker manifold.

DESCRIPTION OF THE PREFERRED EMBODIMENT

Figure 1:
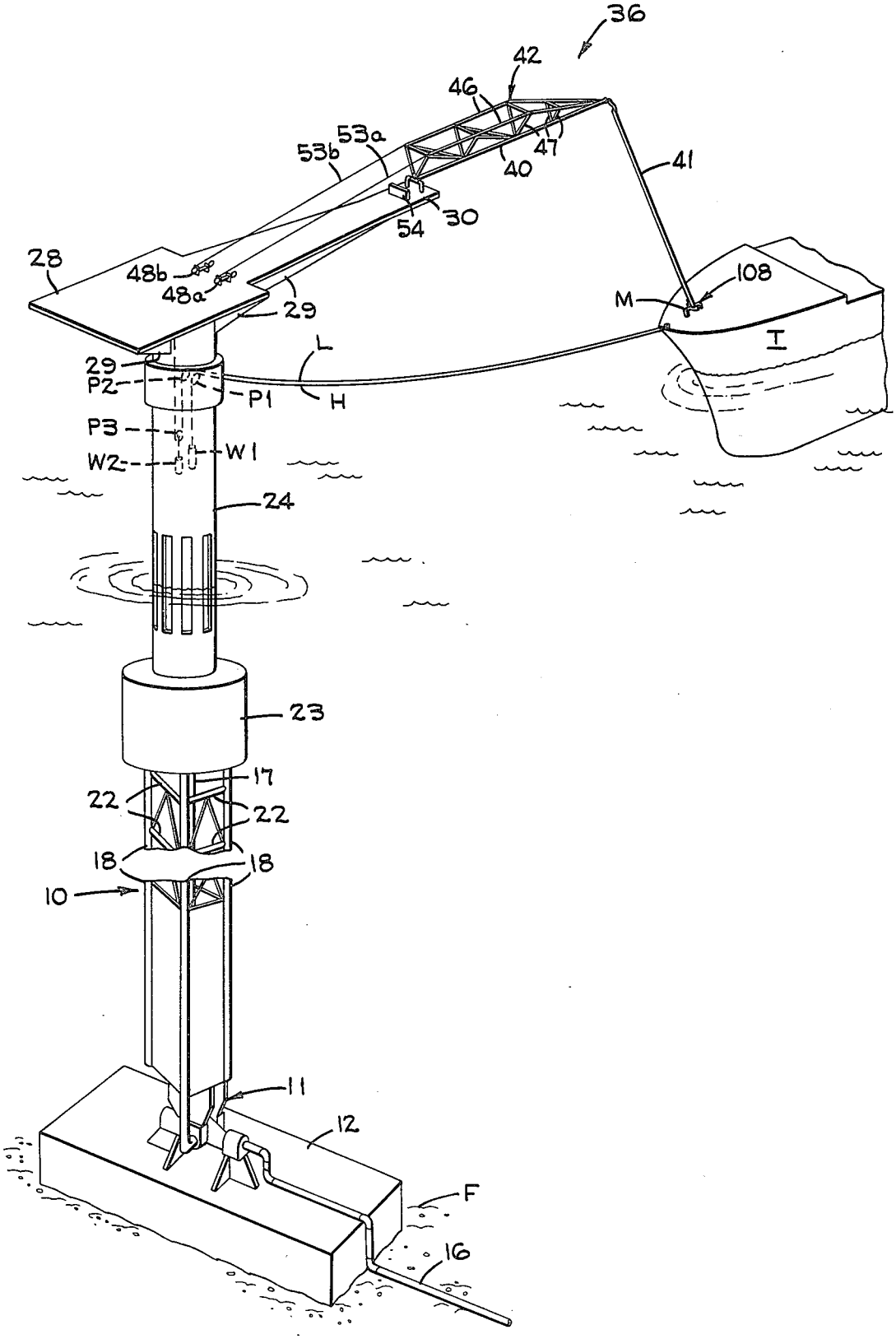
FIG. 1 is a perspective view of an offshore loading system according to the present invention with the loading arm connected in operating position to a marine tanker.

A loading system for transferring fluid from an offshore facility to a tanker manifold comprises an articulated vertical column 10 (FIG. 1) pivotally connected by a universal joint 11 to a concrete or metal base 12 mounted on the ocean floor F. A fluid supply conduit 16, connected to a source of petroleum (not shown), is connected by the universal joint 11 to a vertical supply conduit 17 which extends upward through the interior of the articulated column 10. The lower portion of the column includes a plurality of vertical support rods 18 interconnected by a plurality of braces 22 that provide strength to the column while presenting a relatively small surface to ocean currents flowing through the area about the column. An air-filled buoy 23, connected to the upper end of the vertical support rods 18 and mounted below the surface of the water, holds the articulated column 10 in a generally vertical position. A cylindrical upper portion 24, having a large combination deck and helicopter landing pad 28 at the upper end thereof, is connected to the top of the buoy 23, and additional support for the deck is provided by a plurality of braces 29 connected between the deck 28 and the cylindrical portion 24. The deck includes a narrow extended portion 30 projected radially outward from the articulated column 24 for supporting a loading arm a distance away from the column 24. A horizontal fluid supply conduit 17*a* (FIGS. 2 and 3) extends from the top of the vertical conduit 17 through the deck supports 29, to the outboard portion of the deck 30.

An articulated loading arm 36 (FIGS. 1–3) mounted on the deck extension 30 transfers fluid between the outboard end of the fluid conduit 17*a* and a tanker manifold M mounted on a tanker T, and compensates for relative movement between the tanker and deck. The loading arm 36 includes an inboard conduit member 40 having an inboard end pivotally connected between the outboard end of the fluid conduit 17*a* and an inboard end of an outboard conduit member 41. A horizontal support structure 42, comprising a plurality of tubular rods 46 (FIGS. 2 and 3) and braces 47 connected to the inboard conduit member 40, provides support for the inboard conduit member. A walkway 49 (FIGS. 2 and 3), connected to the support structure 42 and to the conduit member 40, provides access to the various joints along the loading arm to facilitate maintenance and repair without dismantling the arm.

The tanker T is secured to the articulated column 10 (FIG. 1) by one or more hawsers H which allow the tanker to swing freely according to the dictates of wind and current, and to retain the tanker a proper distance from the deck extension 30 while the tanker is loaded through the articulated loading arm 36. Also connected between the tanker and the articulated column 10 are one or more control lines L, comprising one or more pneumatic and/or electric lines, to couple power from the tanker to the articulated column for controlling connection, operation and disconnection of the loading arm. The hawser H and the control lines L are threaded over a plurality of pulleys P1–P3 and connected to counterweights W1,W2 to facilitate storage of the hawser and lines in the articulated column 10 when they are not in use. The illustrated articulated column 10 does not provide any power for operation of the loading system, all such power being provided through the control lines L by the tanker T. It is also possible to mount power sources on the articulated column 10 and to control these power sources by telemetric means.

Figures 2, 3:
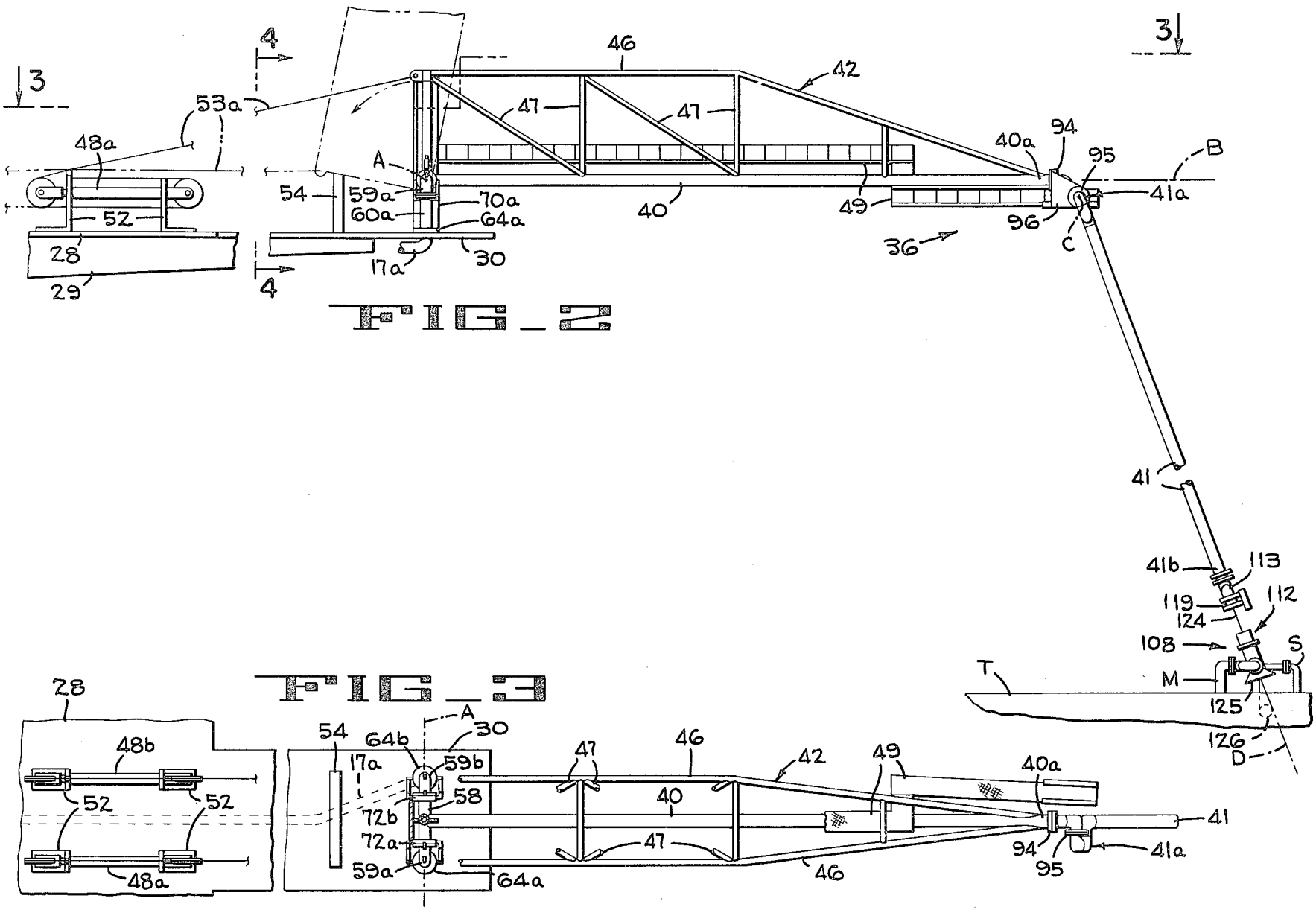
FIG. 2 is an enlarged side elevation of a portion of the offshore loading system shown in FIG. 1.
FIG. 3 is a plan view of the offshore loading system taken in the direction of the arrows 3—3 of FIG. 2.

A pair of tensioners 48*a*,48*b* (FIGS. 1–3), mounted on the deck 28 by a plurality of angle brackets 52 and connected to the support structure 42 by a pair of support chains 53*a*,53*b*, provide power to pivot the articulated loading arm 36 about a horizontal axis A (FIGS. 2 and 3) between the "working" position shown in the solid lines of FIG. 2 and a "stowed" position shown in the phantom lines. A support structure stop 54 (FIGS. 2 and 3) limits the counterclockwise rotation (FIG. 2) of the loading arm 36 to the phantom position shown and prevents the arm from reaching a completely vertical position. This insures that the action of gravity on the loading arm will cause it to pivot clockwise into the working position when the tensioners 48*a*,48*b* relax the tension on the support chains 53*a*,53*b*. One tensioner which may be used with the present invention is the 80,000 pound chain riser tensioner available from the Shaffer division of NL Industries, Inc., Houston, Texas.

The inboard end of the conduit member 40 is connected to the supporting deck extension 30 by a T-section 58 (FIG. 3) connected between the conduit member 40 and the pair of 90-degree elbows 59*a*,59*b* and by a pair of vertical pipes 60*a*,60*b* best shown in FIG. 4. A pair of radial flanges 64*a*,64*b* (FIG. 4) at the lower end of the pipes 60*a*,60*b* are welded or otherwise secured to the deck extension 30 and another pair of radial flanges 65*a*,65*b* at the upper end of the pipes 60*a*,60*b* are connected to a pair of radial flanges 66*a*,66*b* on the elbows 59*a*,59*b*. The lower end of the pipe 60*b* is connected to the upper end of the supply conduit 17*a* but the pipe 60*a* is used only for the support of the articulated loading arm 36, although the pipe 60*a* could be used to carry fluid in installations where a second supply conduit is available. Additional support of the loading arm 36 is provided by a pair of vertical support beams 70*a*,70*b* (FIGS. 4 and 5) connected between the flanges 64*a*,64*b* and a pair of support plates 71*a*,71*b*. At one end of the support plates 71*a*,71*b* are each welded to one of the support beams 70*a*,70*b* and to one of the flanges 65*a*,65*b* and at the other end of the plates 71*a*,71*b* are welded to the outer portion of a pair of swivel joints 72*a*,72*b* to provide enough support for the loading arm 36 so that the elbows 59*a*,59*b* can be removed either partially or completely, for service (FIG. 5) without disconnecting the loading arm from the deck extension 30.

The elbows 59*a*,59*b* are connected to swivel joints 72*a*,72*b* by a pair of hinges 76*a*,76*b*, each connected between a swivel joint and a flange 77*a*,77*b* (FIGS. 4 and 5) on the elbows. Power to lift the elbows into position for replacing an annular seal or for other service is provided by a pair of hydraulic jacks 82*a*,82*b* removably connected between an ear 83*a*,83*b* on the elbows and a brace 84 which is welded or otherwise connected to the inboard conduit member 40. The jacks 82*a*,82*b* are connected to the ears 83*a*,83*b* and to the brace 84 by a plurality of removable pins 88, the jacks normally being connected to the ears and brace only during the time that the elbows and the swivel joints are being serviced. When the seal 78*b* (FIG. 5) is to be replaced, the articulated loading arm 36 (FIG. 4) is lowered into the working position shown in FIGS. 2 and 4, the hydraulic jack 82*b* is connected in position by the pins 88 at either end, the flange 66*b* of the elbow 59*b* is disconnected from the flange 65*b* of the vertical pipe 60*b* and the jack 82*b* is retracted to rotate the elbow 59*b* clockwise about the hinge 76*b* to expose the seal 78*b*. The seal 78*b* is replaced, the elbow 59*b* lowered into the operating position (FIG. 4), the elbow flange 66*b* secured to the flange 65*b* and the hydraulic jack disconnected by removing the pins 88. A brace 89 (FIG. 4) welded or otherwise connected between the swivel joints 72*a* and 72*b* provide support for the T-section 58.

An outboard end 40*a* (FIG. 6) of the inboard conduit member 40 is connected to the inboard end 41*a* of the outboard conduit member 41 (FIGS. 2, 3 and 6) by a pair of elbows 90,91 and a pair of swivel joints 94,95 with the conduit member 41 pivoting about the generally horizontal axis B and about the horizontal axis C. The inboard end 41*a* includes a plurality of elbows 92*a*–92*c* interconnected between the swivel joint 95 and the conduit member 41. The joint 94 (FIG. 6) swivels about the end 40*a* of the conduit 40 and the inboard end 41*a* of the conduit 41 swivels inside the joint 95. A support bracket 96 having one end welded to the joint 94 and the other end welded to the joint 95, provides support so that the elbow 90 can be repaired or replaced without disconnecting the outboard conduit member 41 from the inboard conduit member 42. The elbow 90 is connected to the swivel 94 by a hinge 100 and a hydraulic jack 101 is removably connected between an ear 102 on the elbow 90 and a brace 106 which is welded or otherwise connected to the end 40*a* of the inboard conduit member 40. The hydraulic jack 101 is normally between the ear and brace only during the time that the elbow and swivel joints are being serviced. When either of the joints 94,95 is to be serviced, the jack 101 is connected to the ear 102 by a pin 107 and to the brace 106 by a pin 109. A flange 91*a* of the elbow 91 is disconnected from the joint 95 and the hydraulic jack 101 is retracted to pivot the elbows about the hinge 100 so that seals can be replaced or other work performed on the joints 94,95. The jack 101 is disconnected after the service work has been performed.

The lower end 41*b* (FIGS. 2 and 7) of the outboard conduit member 41 is connected to the tanker manifold M by a universal joint means 108 and by a guide assembly 112. The guide assembly 112 includes a double elbow 113 having a flange 114 (FIG. 7) on the upper end connected to a swivel joint 118 on the end 41*b* of the conduit member and having a radial flange 117 on the lower end of the elbow connected to a butterfly valve 119. A guide probe 120 welded to a center portion of the elbow 113 is connected to a pull-in cable 124 which is threaded through a guide funnel 125 and connected to a pull-in winch 126. The universal joint means 108 includes a plurality of swivel joints 130*a*–130*d*, a pair of triple elbows 131*a*, 131*b* and a Tee pipe 132 interconnected between the tanker manifold M and a support pipe S. The swivel joints 130*b*, 130*c* allow the guide funnel 125 and a pipe connector 136 to pivot about a horizontal axis E, while the swivel joints 130*a*, 130*d* allow the funnel 125 and the pipe connector 136 to pivot about a horizontal axis F.

When the tanker T (FIG. 1) is moved into loading position adjacent the articulated column 10, the ends of the hawser H and the control lines L are grasped and pulled out for connection to the tanker. The lower end of pull-in cable 124 is grasped and threaded through the guide funnel 125 where it is secured to the winch 126, and the winch energized to pull the guide probe 120 (FIG. 7) toward the funnel 125. A guide member 139 extending radially outward from the probe 120 engages a tapered guide groove 140 in the wall of the guide funnel to pivot the guide assembly 112 about the axis D and align the coupling flange 137 on the butterfly valve with the coupling flange 138 on the connector 136. A plurality of hook-like clamps 142 secure the coupling flanges 137 and 138 together in a fluid-tight connection. The butterfly valve 119 is opened by energizing a valve operator 119*a* to allow the transfer of fluid from the loading arm into the tanker manifold M.

Figure 8:
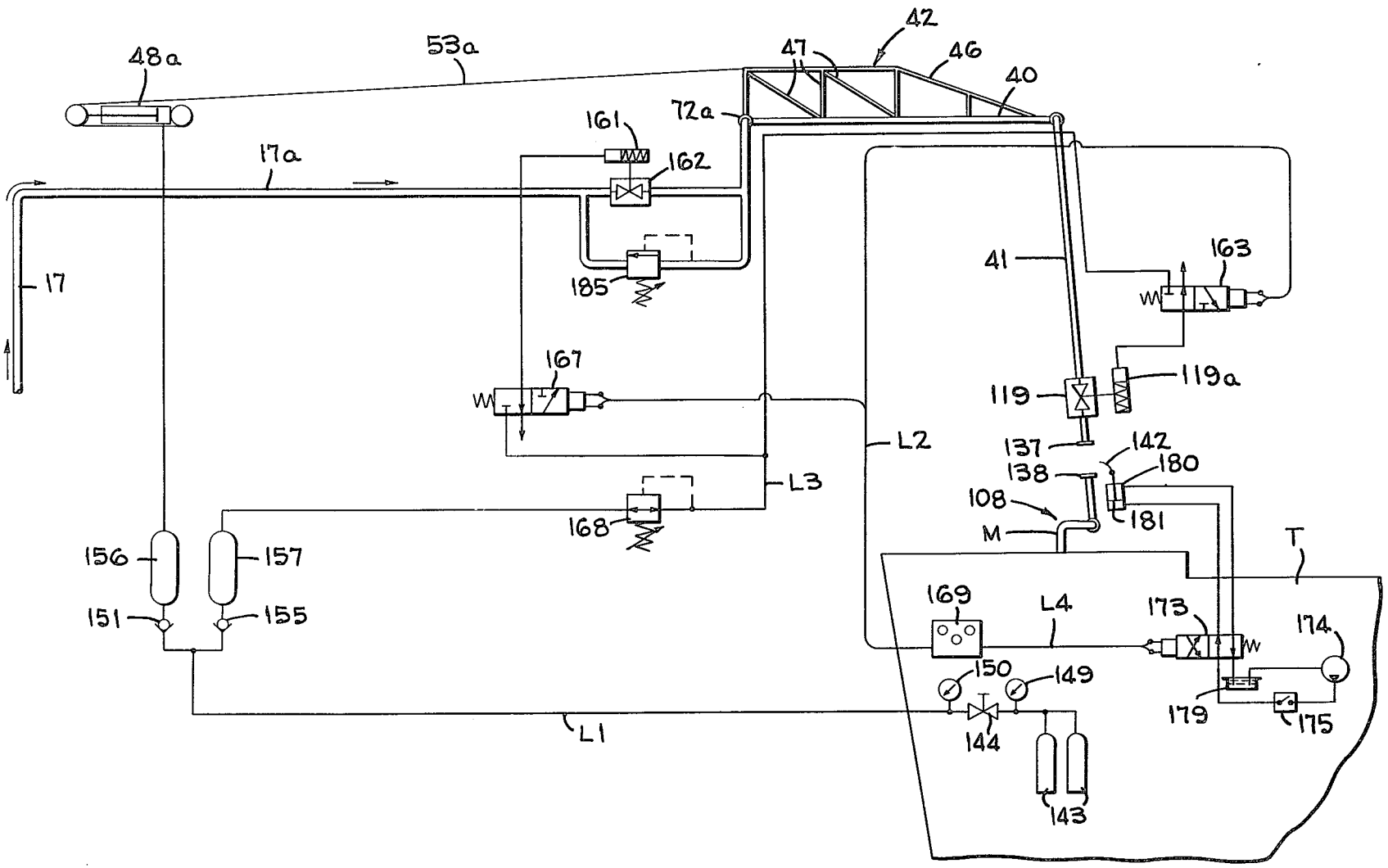
FIG. 8 is a schematic diagram of the hydraulic and electric control system for raising, lowering and operating the loading arm of the present invention.

The hydraulic, pneumatic and electric circuitry for controlling the operation of the loading arm and the associated valves (FIG. 8) includes a pneumatic pressurized source 143 connected to a pneumatic supply line L1 through a shutoff valve 144 and monitored by a pair of pressure gauges 149,150. A pair of check valves 151,155 and a pair of accumulators 156,157 stabilize the pneumatic pressure for accurate control of the tensioners and the valve operators. The valve operator 119*a* and a valve operator 161 are individually controlled by a pair of electrically operated spool valves 163,167 to open and close the fluid control valves 119 and 162. A regulator 168 controls the gas pressure on a pneumatic line L3, and an electrical control panel 169 provides electrical signals on the cable L2 to control the operation of the spool valves 163,167 and signal on the cable L4 to control the operation of a spool valve 173. A hydraulic pump 174, a switch 175, a reservoir 179 and the spool valve 173 (FIG. 8) provide power to control a hydraulic coupler operator 180 (FIGS. 7 and 8) and to operate the clamps 142. When the spool valve 173 is in the deenergized position shown in FIG. 8, a piston 181 is moved upward in the operator 180 to open the clamps 142 and release the flanges 137,138 so that the loading arm 36 can be disconnected from the tanker T. When the spool valves 163,167 are in the deenergized position shown in FIG. 8, the valves 119,162 are closed to prevent the flow of fluid through the loading arm 36. A relief valve 185 relieves excessive fluid pressure in the loading arm which can be caused by thermal expansion of the fluid contained in the conduit members 40,41 while the valves 119 and 162 are closed.

Providing electrical signals to the valves 163,167,173 on the electrical lines L2,L4 shifts the valves into the energized position to supply hydraulic fluid to the coupler 180 which clamps the flanges 137,138 together and provides pneumatic pressure to the valve operators 161,119*a* to open the butterfly valves 162,119 and allow fluid transfer from the supply conduit 17 to the tanker manifold M.

The various controls and switches on the control panel 169 can be manually controlled, or positioned sensors, such as potentiometers, can be mounted to sense the orientation of the inboard conduit member 40 relative to the supply conduit 17*a* and to sense the orientation of the outboard conduit member 41 relative to the inboard conduit member. Electrical circuitry of the type disclosed in the U.S. Pat. No. 4,084,277 issued to Peter Ball, Apr. 11, 1978, can use signals from these sensors to determine the position of the outboard end of the loading arm 36 and to shut the valves 119,162 and disconnect the loading arm from the tanker when the out-board end of the loading arm reaches an unsafe position.

The present invention provides a lightweight loading arm having a tensioner to maintain a zero relative motion between the tanker and the outboard end of the loading arm except for the effect of the pull-in winch. The lightweight tensioner eliminates the need for a counterweight used in other loading arms. During the connect operation the loading arm is biased away from the tanker by the tensioner to eliminate collision between the arm and the tanker. Seals in the swivel joints of the loading arm can be quickly replaced without dismantling the loading arm and the valve at the outboard end of the loading arm prevents spillage of fluid when the arm is disconnected from the tanker manifold. The service life of the loading arm is many times longer than the life of flexible hoses which were previously used for transferring fluid from an articulated column to a marine tanker and the articulated loading arm can be disconnected from the tanker faster and safer than the flexible hoses.

Although the best mode contemplated for carrying out the present invention has been herein shown and described, it will be apparent that modification and variation may be made without departing from what is regarded to be the subject matter of the invention.

What is claimed is:

1. An offshore loading system for transferring fluid from an articulated column to a manifold on a marine tanker and to provide for relative movement between said tanker and said column, and for controlling the operation of said system from said marine tanker, said system comprising:

a support structure having an inboard end pivotally connected to said articulated column;

an inboard conduit member, said inboard conduit member being mounted along said support structure with an inboard end of said inboard conduit member pivotally connected to said articulated column for pivotal movement about a first horizontal axis;

power supply means mounted on said marine tanker;

means for coupling power from said power supply means on said marine tanker to said support structure to pivotally move said inboard conduit member about said first horizontal axis;

an outboard conduit member;

means for connecting an inboard end of said outboard conduit member to an outboard end of said inboard conduit member for pivotal movement about a second and a third horizontal axis; and universal joint means for pivotally connecting an outboard end of said outboard conduit member to said tanker manifold.

2. An offshore loading system as defined in claim 1 including a tensioner for pivotally moving said inboard conduit member about said first horizontal axis, means for mounting said tensioner to said articulated column, and means for connecting said tensioner to said support structure.

3. An offshore loading system as defined in claim 2 including means for coupling said power supply means to said tensioner to selectively raise and lower said outboard end of said inboard conduit member.

4. An offshore loading system as defined in claim 1 including a swivel joint connected between said articulated column and said inboard end of said inboard conduit member, and piping support means connected between an outer portion of said swivel joint and said articulated column to facilitate repair of portions of said swivel joint while said inboard conduit remains in an operating position.

5. An offshore loading system as defined in claim 1 including a swivel joint means connected between said inboard end and said outboard end of said outboard conduit member.

6. An offshore loading system for transferring fluid from an articulated column to a marine tanker manifold, for providing for relative movement between said tanker and said column, and for controlling the operation of said system from said marine tanker, said system comprising:

an inboard conduit member;

means for pivotally connecting an inboard end of said inboard conduit member to said articulated column for pivotal movement about a first horizontal axis;

an outboard conduit member;

means for pivotally connecting an inboard end of said outboard conduit member to an outboard end of said inboard conduit member for pivotal movement of said outboard member about a second and a third generally horizontal axis;

a fluid control valve;

a swivel joint connected between said fluid control valve and an outboard end of said outboard conduit member;

power supply means mounted on said marine tanker;

means for coupling power from said power supply means on said tanker to said control valve to control operation of said valve; and universal joint means connected between said fluid control valve and said tanker manifold.

7. An offshore loading system as defined in claim 6 wherein said universal joint means is pivotally mounted for movement about a pair of horizontal axes, one of said pair of horizontal axes being positioned at substantially 90 degrees relative to the other of said pair of horizontal axes.

8. An offshore loading system as defined in claim 6 including a generally S-shaped elbow connected between said swivel joint and said fluid control valve to facilitate rotational movement of said fluid control valve in an arc about an axis of said outboard conduit member.

9. An offshore loading system as defined in claim 6 including means for coupling power from said power supply means to said pivot means for pivotally moving said inboard conduit member about said first horizontal axis.

10. An offshore loading system as defined in claim 1 including power lines mounted in said support structure and extendable between said support structure and said tanker, and meas for connecting said power lines to said power supply means to control the operation of said inboard and said outboard conduit members.

11. An offshore loading system as defined in claim 10 including a tensioner for pivotally moving said inboard conduit member about said first horizontal axis, and means for coupling said tensioner to said power lines to selectively raise and lower said outboard end of said inboard conduit member.

12. An offshore loading system as defined in claim 10 including a plurality of valves connected to said inboard and said outboard conduit members, and means for connecting said valves to said power lines to selectively control the flow of fluid through said conduit members by controlling said valves.

13. An offshore loading system for transferring fluid from an articulated column to a marine tanker manifold and for controlling the operation of said system from said marine tanker, said system comprising:

an inboard conduit member;

means for pivotally connecting an inboard end of said inboard conduit member to said articulated column for pivotal movement about a first horizontal axis;

an outboard conduit member;

means for pivotally connecting an inboard end of said outboard conduit member to an outboard end of said inboard conduit member for pivotal movement of said outboard member about a second and a third generally horizontal axis;

a fluid control valve;

means for connecting said control valve between said articulated column and said inboard end of said inboard conduit member;

universal joint means for pivotally connecting an outboard end of said outboard conduit member to said tanker manifold;

power supply means mounted on said marine tanker; and means for coupling said power supply means from said tanker to said control valve to control fluid in said inboard and said outboard conduit members in response to signals from said power supply means.

14. An offshore loading system as claimed in claim 13 including power lines mounted in said support structure and extendable between said support structure and said tanker, and means for connecting said power lines to said power supply means to control the operation of said inboard and said outboard conduit members.

* * * * *